US008887798B2

(12) United States Patent
Simson et al.

(10) Patent No.: US 8,887,798 B2
(45) Date of Patent: Nov. 18, 2014

(54) HYDRAULIC STABILIZER FOR USE WITH A DOWNHOLE CASING CUTTER

(75) Inventors: James A. Simson, Meadows Place, TX (US); Ronald G. Schmidt, Tomball, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 695 days.

(21) Appl. No.: 13/218,159

(22) Filed: Aug. 25, 2011

(65) Prior Publication Data

US 2013/0048287 A1 Feb. 28, 2013

(51) Int. Cl.

| | |
|---|---|
| ***E21B 43/11*** | (2006.01) |
| ***E21B 17/10*** | (2006.01) |
| ***E21B 23/00*** | (2006.01) |
| ***E21B 29/00*** | (2006.01) |

(52) U.S. Cl.

CPC ..... *E21B 17/1014* (2013.01); *E21B 29/002* (2013.01)

USPC ..... 166/55; 166/241.6; 166/217

(58) Field of Classification Search

USPC ..... 166/298, 241.6, 55, 55.1, 55.3, 55.7, 166/55.8, 212, 215, 217; 175/263, 266, 175/269, 271, 273, 284, 288

See application file for complete search history.

(56) References Cited

U.S. PATENT DOCUMENTS

| | | | | |
|---|---|---|---|---|
| 3,098,534 | A | 7/1963 | Carr et al. | |
| 3,370,657 | A | 2/1968 | Antle | |
| 3,489,211 | A * | 1/1970 | Kammerer, Jr. | 166/361 |
| 4,776,394 | A | 10/1988 | Lynde et al. | |
| 5,265,675 | A | 11/1993 | Hearn et al. | |
| 5,456,312 | A | 10/1995 | Lynde et al. | |
| 5,732,770 | A | 3/1998 | Beeman | |
| 5,836,406 | A | 11/1998 | Schuh | |
| 6,241,017 | B1 | 6/2001 | Doane et al. | |
| 6,453,998 | B1 | 9/2002 | Reeve | |
| 6,679,328 | B2 | 1/2004 | Davis et al. | |
| 6,935,423 | B2 | 8/2005 | Kusmer | |
| 7,178,589 | B2 * | 2/2007 | Campbell et al. | 166/216 |
| 7,377,328 | B2 * | 5/2008 | Dewey et al. | 166/387 |
| 7,448,446 | B2 * | 11/2008 | Campbell et al. | 166/216 |
| 7,493,971 | B2 | 2/2009 | Nevlud | |
| 7,891,441 | B2 * | 2/2011 | Lee | 175/267 |
| 2005/0194151 | A1 * | 9/2005 | Dewey et al. | 166/382 |
| 2006/0207797 | A1 | 9/2006 | Dewey et al. | |
| 2007/0181298 | A1 | 8/2007 | Sheiretov et al. | |
| 2010/0288491 | A1 | 11/2010 | Cochran et al. | |
| 2012/0325480 | A1 * | 12/2012 | Schmidt et al. | 166/298 |

OTHER PUBLICATIONS

International Search Report and Written Opinion of PCT Application No. PCT/US2012/052201 dated Jan. 21, 2013: pp. 1-10.

* cited by examiner

*Primary Examiner* — Kenneth L Thompson
*Assistant Examiner* — Michael Wills, III

(57) ABSTRACT

A downhole stabilizer includes a radial expansion assembly deployed about, and configured to rotate substantially freely with respect to, a tool mandrel. The expansion assembly preferably includes at least one stabilizer block configured to extend radially outward from the mandrel into contact with a wellbore casing string. When deployed between uphole and downhole cones, the stabilizer block preferably includes a plurality of angled splines configured to engage corresponding splines disposed on the cones. Relative axial motion between the stabilizer block and the cones causes a corresponding radial extension or retraction of the block.

22 Claims, 5 Drawing Sheets

HYDRAULIC STABILIZER FOR USE WITH A DOWNHOLE CASING CUTTER

BACKGROUND

Oil and gas wells are ordinarily completed by first cementing metallic casing stringers in the borehole. During the drilling, completion, and production phase, operators often find it necessary to perform various remedial work, repair, and/or maintenance in the casing string. For example, it is sometimes necessary to cut and remove a section of a tubing string or well casing. During a typical cutting operation, it is generally desirable to stabilize the cutting tool so as to improve the efficiency of the cutting operation. Those of ordinary skill in the art will readily appreciate that improved efficiency results in a reduction of time and therefore a cost savings.

Numerous stabilizing and/or centralizing mechanisms are known in the art for use in downhole operations including drilling and workover operations. Such stabilizing mechanisms include, for example, mechanically and hydraulically actuated toggle mechanisms, spring actuated mechanisms, hydraulically actuated cam-driven or cone-driven mechanisms, hydraulically actuated piston mechanisms, as well as standard fixed blade stabilizing mechanisms. While various stabilizing mechanisms have been widely used in downhole operations they are not necessarily well suited for certain casing cutting operations.

For example, toggle mechanisms do not necessarily provide consistent stabilizing force. Toggle mechanisms are also prone to failure in service. Spring mechanisms are not well suited for cutting operations in that they tend to allow radial movement of the stabilized assembly which can negate (or partially negate) the stabilization. Radial piston assemblies, while capable of providing a suitable stabilizing force, are prone to catastrophic seal failure and tend to have geometric constraints. Moreover, piston mechanisms can damage the casing owing to the application of too much radial force. Cam- and cone-driven mechanisms also tend to be limited by geometric constraints, in particular by the amount of radial stroke that can be generated within a downhole assembly. Fixed blade (passive) stabilizers, commonly utilized in drilling operations, allow the required axial translation, but do not generally provide adequate radial stabilization, especially as the blades wear over time. In particular, passive stabilizers have a built-in radial clearance that wears with time and allows for radial movement (and therefore vibration and oscillation that tends to reduce cutting efficiency and damage cutting tools). Hydraulic stabilization mechanisms may provide suitable radial stabilization but tend to have excessive clamping forces that do not allow for axial translation of the cutting tool during the cutting operation.

SUMMARY

The invention disclosed herein addresses one or more of the above-described drawbacks of the prior art. In one exemplary embodiment of the invention, a downhole radial stabilizer is provided for use in casing cutting operations. The stabilizer includes a radial expansion assembly deployed about and configured to rotate substantially freely with respect to a tool mandrel. The radial expansion assembly preferably includes at least one stabilizer block configured to extend radially outward from the mandrel into contact with a wellbore casing string. The stabilizer block may be deployed between uphole and downhole cones and preferably includes a plurality of angled splines configured to engage corresponding splines disposed in the cones. As such, relative axial motion between the stabilizer block and the cones causes a corresponding radial extension or retraction of the block. The stabilizer block is preferably hydraulically actuated.

Exemplary embodiments disclose several technical advantages. For example, one or more embodiments of the invention provide for improved radial stabilization as compared to passive stabilizers and therefore tend to improve the efficiency and reliability of casing cutting operations. Additional benefits can include a reduction in the time necessary to complete the cutting operation and a reduction in cutter wear. Exemplary stabilizer embodiments in accordance with the disclosed invention may also be configured to provide for axial slippage (translation) during the casing cutting operation while at the same time providing suitable radial stabilization. Such axial slippage is highly advantageous when the stabilizer is used in combination with a wing-type casing cutter.

A preferred embodiment of the invention includes a downhole stabilizer. The downhole stabilizer further includes a tool body configured for coupling with a downhole tool string. The tool body is preferably arranged and designed with an axial through bore and a mandrel. A first cone is deployed about the mandrel and includes at least one first cone recess having a set of first cone splines disposed in at least one axial wall of the first cone recess. A second cone is deployed about the mandrel and includes at least one second cone recess having a set of second cone splines disposed in at least one axial wall of the second cone recess. At least one stabilizer block is deployed axially between the first and second cones and is carried in the first and second recesses. The stabilizer block includes at least two sets of stabilizer block splines disposed on at least one lateral face/side thereof. A first of the sets of stabilizer block splines compliments and engages the set of first cone splines and a second of the sets of stabilizer block splines compliments and engages the set of second cone splines. The sets of first cone, second cone and stabilizer block splines are angled with respect to a longitudinal axis of the tool body such that axial translation of the second cone with respect to the first cone either radially extends or retracts the stabilizer block. In another embodiment, the invention may include a string of downhole tools, e.g., a casing cutting tool and the aforementioned stabilizer.

The foregoing has outlined rather broadly the features and technical advantages of one or more embodiments of the invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention.

BRIEF DESCRIPTION OF THE DRAWINGS

For a more complete understanding of the disclosed invention, and the advantages thereof, reference is now made to the following descriptions taken in conjunction with the accompanying drawings, in which.

DETAILED DESCRIPTION OF ONE OR MORE EMBODIMENTS

Figure 1:
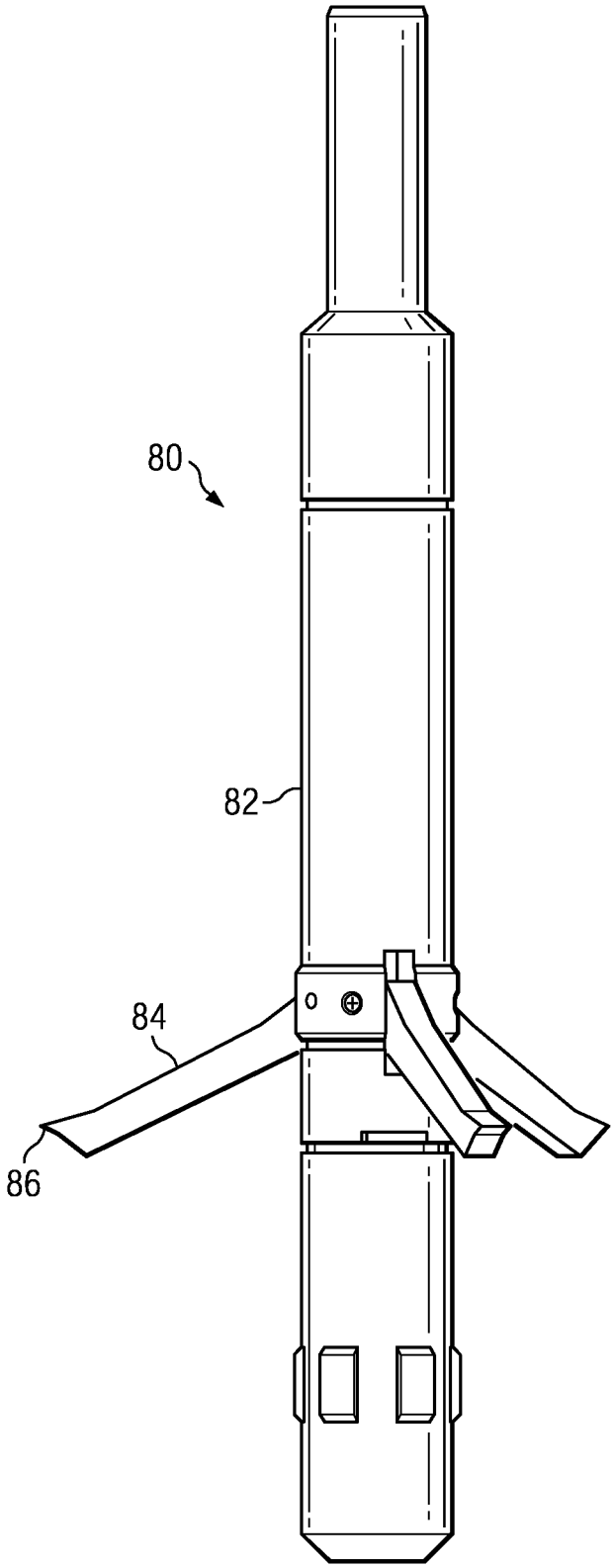
FIG. 1 (PRIOR ART)
FIG. 1 depicts one exemplary prior art casing cutter tool suitable for use in the tool string depicted on FIG. 2.

FIG. 1 depicts an example of a prior art casing cutting tool 80 suitable for use in a tool string. Casing cutting tool 80 includes a plurality of circumferentially spaced cutting arms 84 deployed on a tool body 82. Tool 80 is commonly referred to in the art as a hinge-type cutter or a wing-type cutter as the cutting arms 84 are connected to the tool body 82 via a hinge-like joint. During a typical cutting operation, the tool string and the tool 80 are rotated in the wellbore thereby urging the cutting arms 84 radially outward (e.g., via hydraulic actuation) such that the cutting tips 86 engage the wellbore casing. As the cutting operation progresses and the depth of the cut increases, the cutting arms continue to rotate (pivot) radially outward so as to maintain the engagement of the cutting tips 86 with the wellbore casing. Those of ordinary skill in the art will understand that an axial translation of the tool body 82 in the downhole direction is also required in order to maintain engagement of the cutting tips 86 with the wellbore casing due to the pivoting action of the cutting arms. Achieving optimal stabilization can be particularly problematic with a wing-type (hinge-type) cutting tool 80, such as the one depicted on FIG. 1, because an axial translation of the cutting tool 80 is required during the cutting operation.

Referring to FIGS. 2 through 7, one or more exemplary embodiments of the invention are depicted. With respect to FIGS. 2 through 7, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 2 through 7 may be described herein with respect to that reference numeral shown on other views.

Figure 2:
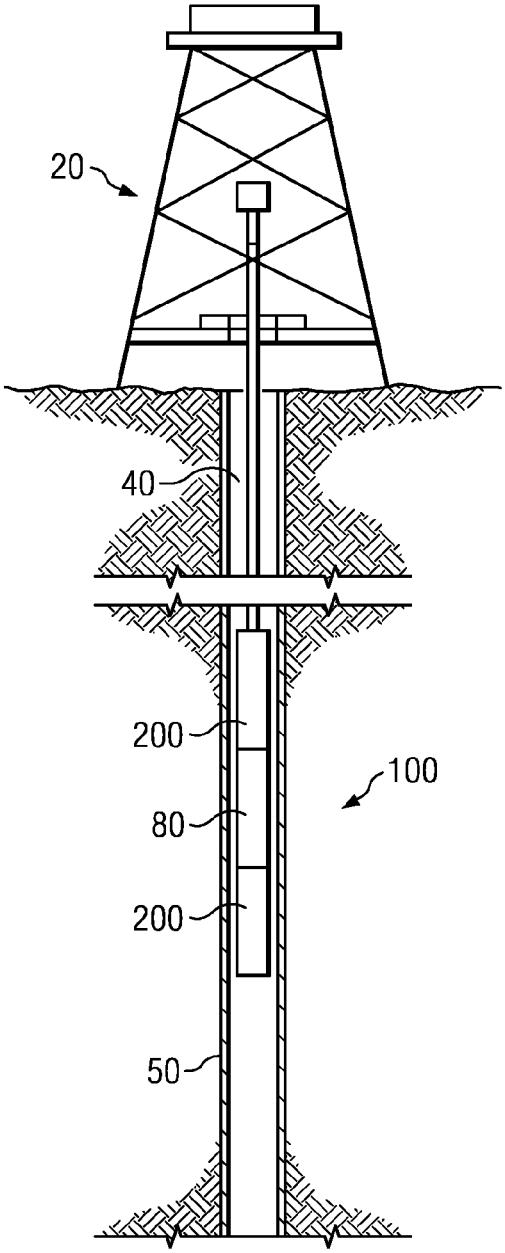
FIG. 2 depicts a conventional drilling rig on which exemplary embodiments in accordance with the invention disclosed herein may be utilized.

FIG. 2 depicts a downhole tool string 100, configured in accordance with one embodiment of the invention, deployed in a cased wellbore 40. A rig 20 is positioned in the vicinity of a subterranean oil or gas formation. The rig may include, for example, a derrick and a hoisting apparatus for lowering and raising various components into and out of the wellbore 40. In the exemplary embodiment depicted, the borehole 40 is at least partially cased with a string of metallic liners 50 (often referred to in the art as a wellbore casing string). The tool string 100 depicted includes first and second stabilizers 200 configured in accordance with the invention disclosed herein and deployed axially about (above and below) a casing cutter 80. It will be understood that the string 100 may include other suitable components as needed for a particular downhole operation and that the invention is not limited to any particular rig configuration, derrick, or hoisting apparatus. It will also be understood that the tool string 100 may be conveyed into the wellbore 40 using substantially any known means, for example only, including a string of connected drill pipe or coiled tubing. The invention is also not limited to any particular means of conveyance.

Figure 3:
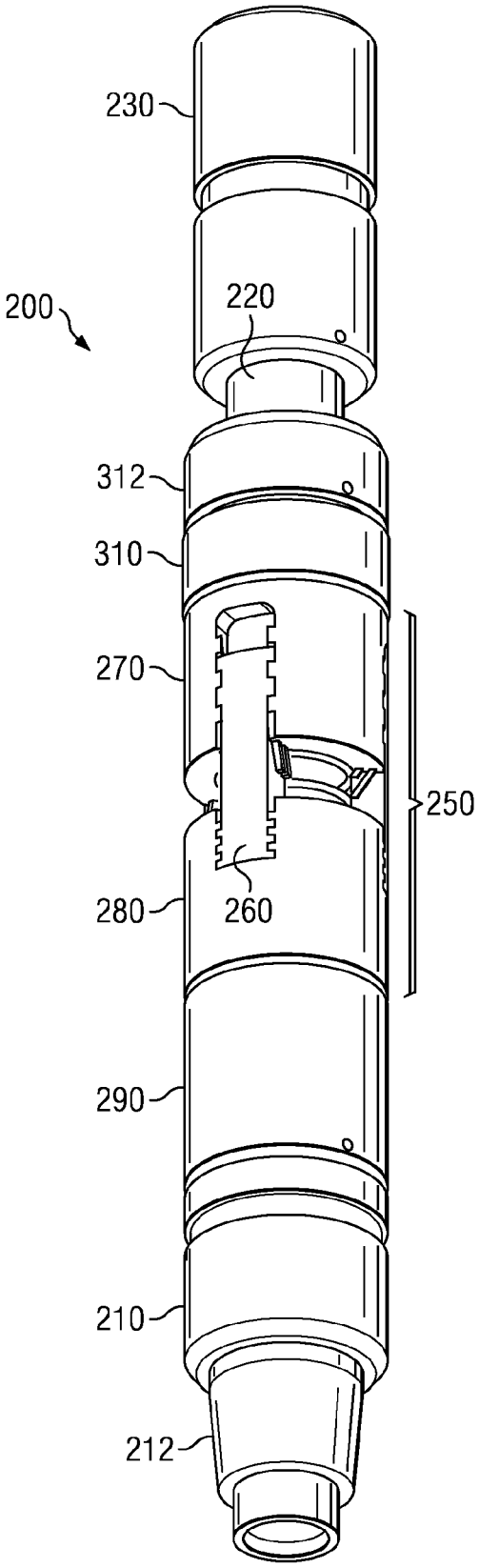
FIG. 3 depicts a perspective view of one exemplary embodiment of a radial stabilizer in accordance with the invention disclosed herein.
Figure 4:
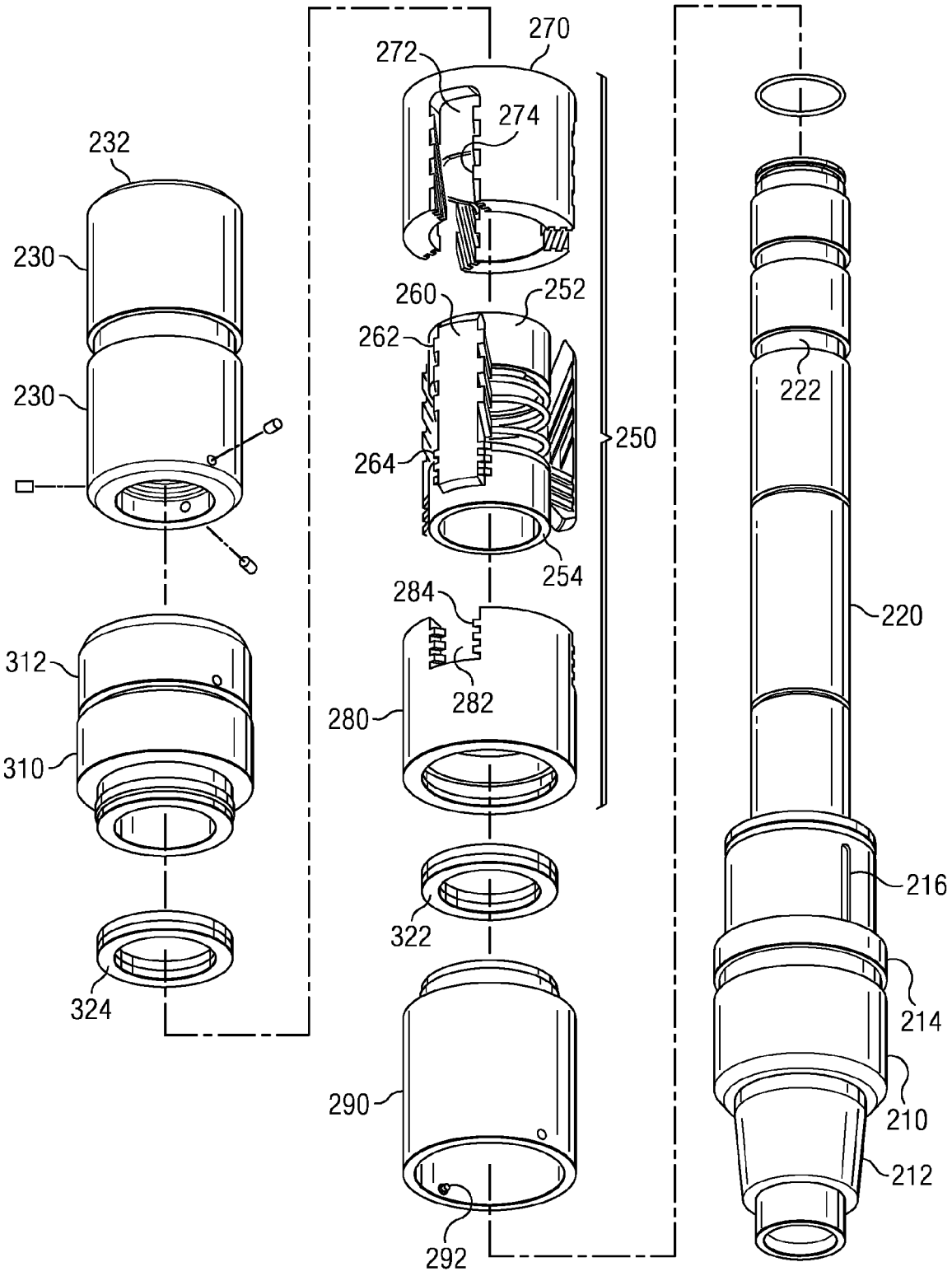
FIG. 4 depicts a partially exploded view of the stabilizer embodiment depicted on FIG. 3.

FIGS. 3 and 4 depict perspective and exploded views of one exemplary embodiment of a radial stabilizer 200 in accordance with the disclosed invention. Radial stabilizer 200 includes a tool body 210 having a downhole threaded end portion 212 and an uphole mandrel portion 220. An upper connection 230 is coupled to an uphole end portion of the mandrel portion 220, for example, via a conventional threaded connection. As shown, upper connection 230 may include a threaded pipe connection 232, although other types of pipe connections are well-known to those skilled in the art and may be equally employed.

Radial stabilizer 200 further includes a radial expansion assembly 250 deployed about the mandrel 220. The expansion assembly 250 includes a plurality of stabilization blocks 260 that are deployed between uphole 270 and downhole 280 cones in corresponding axial slots 272, 282 formed in the cones. The blocks 260 are configured to extend radially outward into contact with the casing when drilling fluid is pumped through a central bore of the tool body 210 and to retract radially inward when the drilling fluid pressure is reduced below a predetermined threshold, as described in more detail below. The radial expansion assembly 250 is configured to generally remain rotationally stationary with respect to the wellbore, while the tool body 210 and other tool components are configured to rotate with the tool string.

Figure 5A:
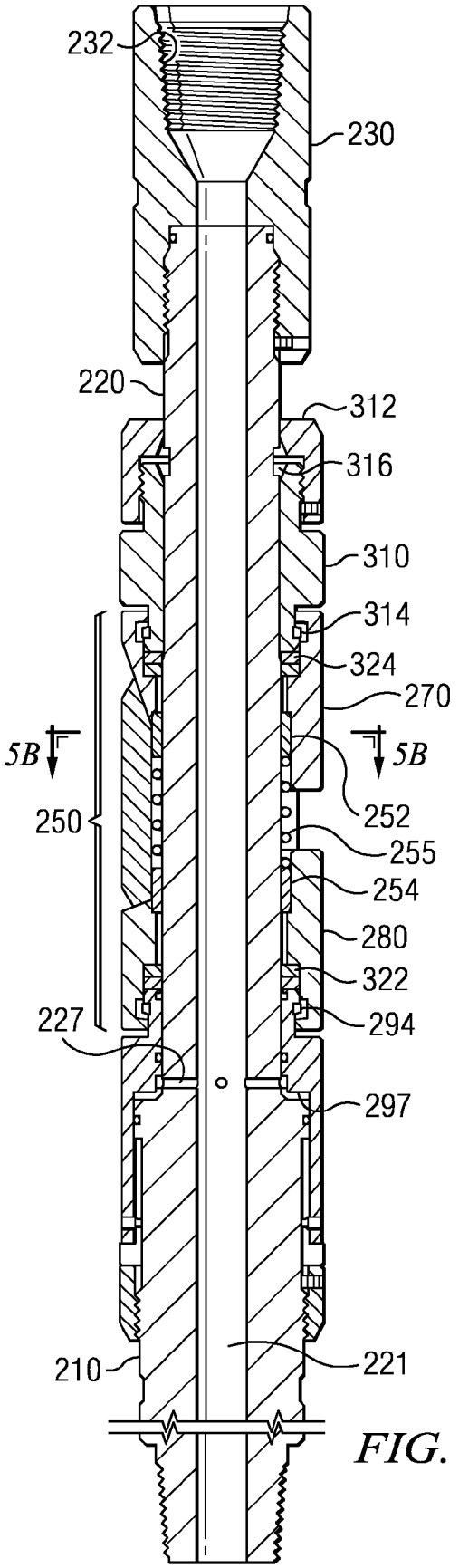
FIGS. 5A and 5B depict longitudinal and circular cross sectional views of the stabilizer of FIG. 3 with the stabilizer blocks in a collapsed position.
Figure 6A:
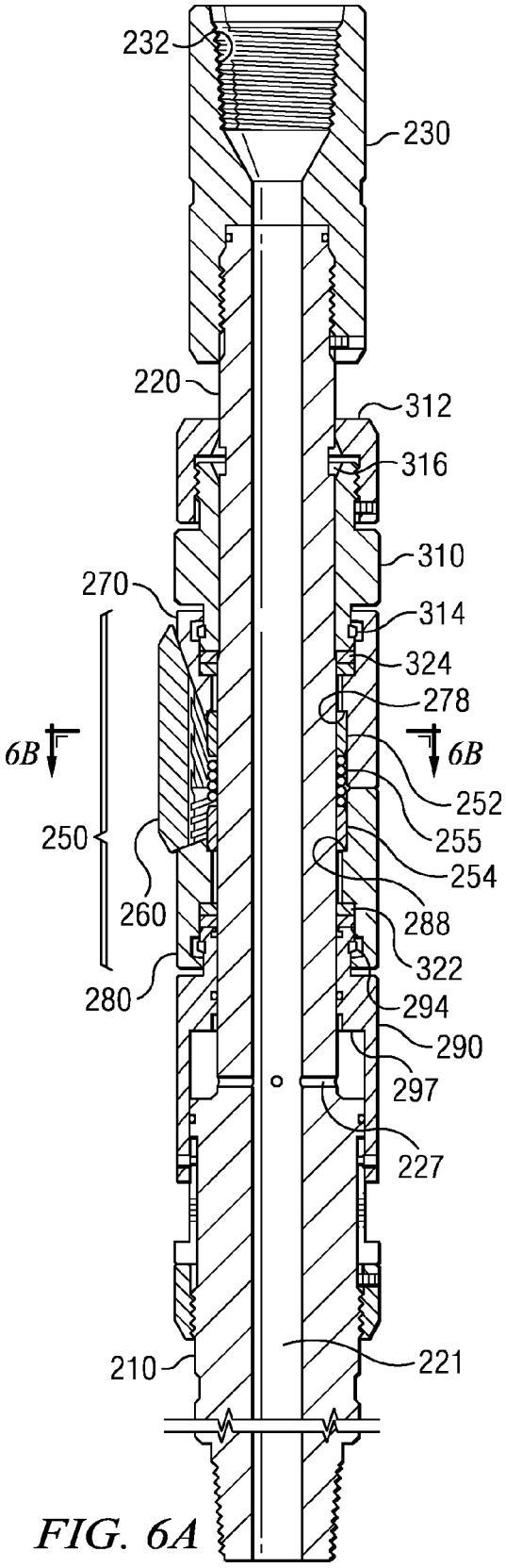
FIGS. 6A and 6B depict longitudinal and circular cross sectional views of the stabilizer of FIG. 3 with the stabilizer blocks in an extended position.

A piston 290 is deployed axially between the downhole cone 280 and a shoulder 214 of the tool body 210. The piston 290 is connected to body 210 via circumferentially spaced pins 292 which engage corresponding elongated grooves 216 formed in the body 210. Engagement of the pins 292 with the grooves 216 rotationally fixes the piston 290 to the tool body 210 (such that they rotate together) while allowing the piston 290 to reciprocate axially with respect to the tool body 210. The piston 290 and downhole cone 280 are connected to one another via snap ring 294 (FIGS. 5A and 6A). The snap ring 294 (FIGS. 5A and 6A) is intended to axially secure the piston 290 and cone 280 to one another while permitting relative rotation. Thrust bearings 322 are deployed axially between the piston 290 and downhole cone 280 and further provide for relative rotation.

Expansion assembly 250 is secured to the mandrel 220 via retainer 310 and cap 312. The retainer 310 and uphole cone 270 are connected to one another via snap ring 314 (FIGS. 5A and 6A). The snap ring 314 is intended to axially secure the retainer 310 and cone 270 to one another while permitting relative rotation. Thrust bearings 324 are deployed axially between the retainer 310 and the uphole cone 270 and further provide for relative rotation. As shown, the cap 312 is threaded to the retainer 310; however, other coupling mechanisms known to those skilled in the art may be employed. A crush ring 316 (FIGS. 5A and 6A) is tightened in a mandrel upset 222 between cap and retainer bevels thereby rotationally fixing the cap 312 and retainer 310 to the mandrel 220 (such that they rotate with the tool body 210). The crush ring 316 (FIGS. 5A and 6A) is also intended to prevent the cap 312 and retainer 310 from translating axially relative to the mandrel 220. The snap ring 314 connection between the retainer 310 and uphole cone 270 further prevents axial translation of the cone 270 with respect to the mandrel 220.

Expansion assembly 250 further includes an internal compression spring 255 deployed axially between radial bearings 252 and 254. Compression spring 255 is configured to bias the radial bearings 252 and 254 into contact with internal shoulders 278 and 288 (FIG. 6A) of cones 270 and 280. The spring 255 therefore biases the cones 270 and 280 in opposite axial directions (i.e., the uphole cone 270 is biased in the uphole direction while the downhole cone 280 is biased in the downhole direction), which in turn biases blocks 260 radially inward toward the mandrel 220. Radial bearings 252 and 254 further provide for rotation of the mandrel 220 in the cones 270 and 280.

As shown in FIG. 4, stabilization block 260 includes first and second sets of angled splines 262 and 264 formed on the lateral sides thereof. In the foregoing discussion, stabilization tool 200 is described with respect to a single stabilization block 260. It will be understood that tools in accordance with the disclosed invention typically, although not necessarily, include multiple stabilization blocks. One or more preferred embodiments include three axially aligned stabilization blocks circumferentially spaced at approximately 120 degree intervals about the tool body. Such a configuration preferably centers the tool in the wellbore upon actuation of the stabilizer blocks. Other configurations may also be employed so as to eccenter the tool in the wellbore. However, the disclosed invention is not limited to these described embodiments.

Splines 262 are sized and shaped to engage corresponding splines 274 formed in recess 272 of uphole cone 270. Splines 264 are sized and shaped to engage corresponding splines 284 in recess 282 of downhole cone 280. Interconnection between the splines 262 and 264 formed on the block 260 and the splines 274 and 284 formed on the cones 270 and 280 advantageously increases the surface area of contact between the block 260 and the cones 270 and 280 thereby typically providing a robust structure suitable for downhole stabilizing operations. By being angled, the splines 262, 264, 274, and 284 are not parallel with a longitudinal axis of the tool 200. Thus, relative axial motion between block 260 and cones 270 and 280 causes a corresponding radial extension or retraction of the block 260.

With continue reference to FIGS. 3 and 4, the first and second sets of splines 262 and 264 are preferably orthogonal to one another. Stated another way, the sum of a first angle between splines 262 and a longitudinal axis of the tool body and a second angle between splines 264 and the longitudinal axis is preferably about 90 degrees. However, the angles between splines 262 and 264 and the longitudinal axis of the tool body may be advantageously selected so as to "tune" the clamping force of the stabilizer block with the cased wellbore. When used in combination with a wing-type casing cutter (e.g., as depicted on FIG. 1), the clamping force is preferably high enough so as to provide sufficient radial stabilization but low enough so as to allow for axial slippage (translation) in the wellbore. Those of ordinary skill in the art will appreciate that a suitable range of clamping forces may depend on many factors, e.g., including, but not limited to, the differential pressure in the tool and the coefficient of friction between the stabilizer block and the casing string. Notwithstanding the above, it has been found that a suitable clamping force may generally be achieved when the angle between the first set of splines 262 and a longitudinal axis of the tool is in a range from about 10 to about 30 degrees, more preferably from about 15 to about 25 degrees and most preferably about 20 degrees and the angle between the second set of splines 264 and the longitudinal axis is in the range from about 60 to about 80 degrees, more preferably from about 65 to about 75 degrees and most preferably about 70 degrees.

It will be readily understood by those skilled in the art that other stabilizer design parameters may also be advantageously selected so as to tune the clamping force. By way of example and not limitation, the clamping force is influenced by the hydraulic force generated to move the one or more stabilizer blocks, the contact area of the stabilizer block, and the length of the stroke and the force required to initiate and complete the cut. In order to obtain an optimum clamping force for any particular cutting operation, the stabilizer design may advantageously be evaluated and optimized to obtain the desired force (or range of forces). The evaluation may include, for example, the generated hydraulic force applied to the one or more blocks, the component of the force applied to the cutters, and/or the frictional force between the stabilizer blocks and the casing. The invention is of course not limited to the aforementioned examples.

Figure 5B:
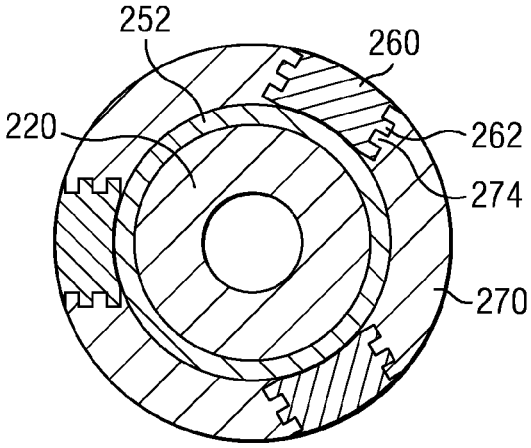
Figure 6B:
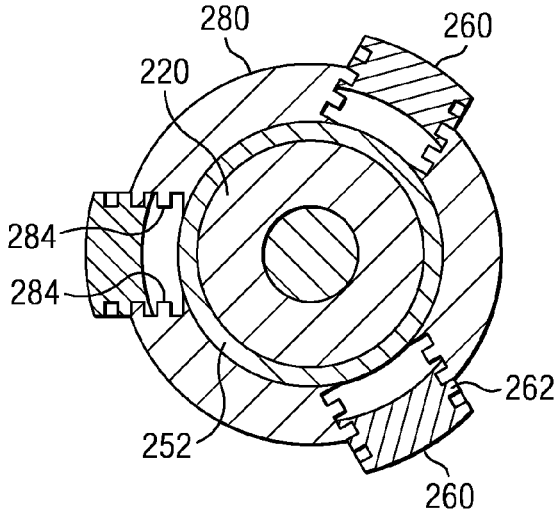

Actuation and deactuation of stabilizer 200 is now described in more detail with respect to FIGS. 5A, 5B, 6A and 6B. In FIGS. 5A and 5B, stabilizer 200 is depicted in a deactuated configuration in which stabilizer blocks 260 are retracted radially inward towards the mandrel 220. In FIGS. 6A and 6B, stabilizer 200 is depicted in a fully actuated configuration in which the stabilizer blocks 260 are substantially fully extended radially outward. In the absence of internal fluid pressure (e.g., a pressure differential between through bore 221 and an annular region external to the tool 200) compression spring 255 biases downhole cone 280 and piston 290 in the downhole direction such that pins 292 slide to a downhole end of groove 216. Translation of cone 280 retracts blocks 260 radially inward via engagement of splines 262 and 264 with splines 274 and 284. During a casing cutting operation, the tool string may be lowered into the wellbore with the stabilization blocks 260 retracted (as depicted on FIGS. 5A and 5B) thereby simplifying passage of the tool string through various restrictions.

Upon deploying the tool string at a desired location, the stabilization blocks 260 may be hydraulically actuated so as to radially stabilize the tool string in the wellbore. Such actuation may be initiated via the introduction of drilling fluid pressure to through bore 221 (e.g., via operation of mud pumps located at the surface). Fluid pressure is communicated to internal surface 297 of piston 290 via ports 227 formed in the mandrel 220. The fluid pressure urges the piston 290 and the downhole cone 280 in the uphole direction (i.e., towards uphole cone 270) against the spring bias. Translation of the downhole cone 280 in the uphole direction causes the expandable blocks to extend radially outward via engagement of splines 262 and 264 with splines 274 and 284. The blocks 260 are fully extended when downhole cone 280 contacts uphole cone 270 as depicted on FIG. 6A.

Figure 7:
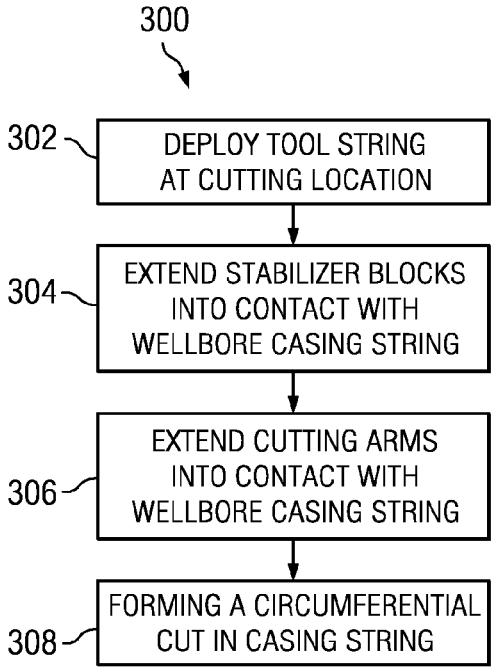
FIG. 7 depicts a flow chart of one exemplary method embodiment in accordance with the invention disclosed herein.

FIG. 7 depicts a flow chart of one exemplary embodiment of a method 300 for a casing cutting operation. At 302, a tool string, which includes a radial stabilizer 200 (according to one or more embodiments disclosed herein) and a wing-type casing cutter 80 (FIG. 1), is deployed in the wellbore at a predetermined cutting location. The stabilizer blocks are extended into contact with the casing string at 304, while the cutting arms are extended into contact with the casing string at 306. In one or more embodiments of the invention, the stabilizer blocks and cutting arms are hydraulically actuated and extended substantially simultaneously, e.g., by pumping drilling fluid through the string of tools. At 308, a circumferential cut is formed in the casing string, for example, by rotating the string of tools (while the cutting arms are extended) in the wellbore. As the cutting operation progresses, the cutting arms continue to extend radially outward, which causes the tool string to translate axially in the wellbore. The stabilizer blocks are preferably configured to provide a clamping force in a desired force range as described above so as to provide adequate radial stabilization with the blocks contacting the wellbore casing while at the same time allowing axial translation (slippage) of the tool string in the wellbore.

While the exemplary embodiments of the disclosed invention are particularly advantageous when used in combination with a conventional wing-type casing cutter (e.g., as depicted on FIG. 1), it will be understood that the invention is not limited to any particular cutter. Generally, any type of casing cutter may be deployed in tool string 100. Cutting tools commonly include a plurality of arms that may be actuated to extend from the tool body and engage the casing. The arms commonly include a plurality of cutting elements, teeth, or inserts configured to engage and form a cut in the casing string upon rotation of the tool string. Actuation of the cutting arms may be hinge-like as described above with respect to FIG. 1 or purely radial. Moreover, any suitable actuation mechanism may be utilized, e.g., including, but not limited to, spring and hydraulic actuation. The invention is not limited in any of these regards.

Although the invention disclosed herein and its advantages have been described in detail, it should be understood that various changes, substitutions and alterations may be made herein without departing from the spirit and scope of the invention as defined by the appended claims.

We claim:

1. A downhole stabilizer comprising:

a tool body arranged and designed to couple with a downhole tool string, the tool body including an axial through bore and a mandrel;

a first cone deployed about the mandrel, the first cone including a first cone recess, the first cone recess having a set of first cone splines disposed in at least one axial wall thereof;

a second cone deployed about the mandrel, the second cone including a second cone recess, the second cone recess having, a set of second cone splines disposed in at least one axial wall thereof; and a stabilizer block deployed axially between the first and second cones and carried in the first and second cone recesses, the stabilizer block having at least two sets of stabilizer block splines disposed on a lateral face thereof, a first of the sets of stabilizer block splines arranged and designed to complement and engage the set of first cone splines and a second of the sets of stabilizer block splines arranged and designed to complement and engage the set of second cone splines;

wherein the first cone, the second cone, and the stabilizer block are configured to rotate substantially freely with respect to the tool body, and wherein the sets of first cone splines, second cone splines, and stabilizer block splines are each angled with respect to a longitudinal axis of the tool body such that axial translation of the second cone with respect to the first cone either radially extends or retracts the stabilizer block.

2. The downhole stabilizer of claim 1, wherein the second cone is configured to translate axially with respect to the first cone in response to a differential pressure between the through bore and a region external to the tool body.

3. The downhole stabilizer of claim 1, wherein the first cone, the second cone, and the stabilizer block are configured to rotate substantially freely with respect to at least the mandrel of the tool body.

4. The downhole stabilizer of claim 1, comprising three stabilizer blocks deployed at angular intervals of about 120 degrees about a circumference of the mandrel.

5. The downhole stabilizer of claim 1, further comprising a piston deployed about the mandrel and axially between the second cone and a shoulder deployed on the tool body. the piston being rotationally fixed to the tool body and configured to reciprocate axially with respect to the tool body.

6. The downhole stabilizer of claim 5, wherein the piston comprises an internal surface in fluid communication with the through bore such that a differential pressure in the through bore urges the piston and the second cone axially towards the first cone, thereby urging the stabilizer block radially outward.

7. The downhole stabilizer of claim 6, wherein the second cone and the piston are spring, biased away from the first cone and towards the shoulder, thereby spring biasing the stabilizer block radially inward.

8. The downhole stabilizer of claim 1, wherein the first cone is axially fixed to the mandrel.

9. The downhole stabilizer of claim 1, wherein an angle between the first set of stabilizer block splines and the longitudinal axis is in the range from about 10 to about 30 degrees.

10. The downhole stabilizer of claim 1, wherein an angle between the second set of stabilizer block splines and the longitudinal axis is in the range from about 60 to about 80 degrees.

11. The downhole stabilizer of claim 1, wherein the first and second sets of stabilizer block splines are substantially orthogonal to one another.

12. A string of downhole tools configured to cut a wellbore casing, the string of downhole tools comprising:

a casing cutting tool; and at least one downhole radial stabilizer including:

a tool body coupled with the casing cutting tool, the tool body including an axial through bore and a mandrel;

a first cone deployed about the mandrel, the first cone including a first cone recess, the first cone recess having a set of first cone splines disposed in at least one axial wall thereof;

a second cone deployed about the mandrel, the second cone including a second cone recess, the second cone recess having a set of second cone splines disposed in at least one axial wall thereof; and a stabilizer block deployed axially between the first and second cones and carried in the first and second cone recesses, the stabilizer block having at least two sets of stabilizer block splines disposed on a lateral side thereof, a first of the sets of stabilizer block splines configured to complement and engage the set of first cone splines and a second of the sets of stabilizer block splines configured to complement and engage the set of second cone splines;

wherein the first cone, the second cone, and the stabilizer block are configured to rotate substantially freely with respect to the tool body, and wherein the sets of first cone splines, second cone splines, and stabilizer block splines are each angled with respect to a longitudinal axis of the tool body such that axial translation of the second cone with respect to the first cone either radially extends or retracts the stabilizer block.

13. The string of downhole tools of claim 12, wherein the first cone, the second cone, and the stabilizer block are configured to rotate substantially freely with respect to at least the mandrel of the tool body.

14. The string of downhole tools of claim 12, wherein:

an angle between the first set of stabilizer block splines and the longitudinal axis is in the range from about 10 to about 30 degrees; and an angle between the second set of stabilizer block splines and the longitudinal axis is in the range from about 60 to about 80 degrees.

15. The string of downhole tools of claim 14, wherein the first and second sets of stabilizer block splines are substantially orthogonal to one another.

16. The string of downhole tools of claim 12, wherein:

the casing cutting tool is configured such that the string of downhole tools translates axially as cutting progresses during a casing cutting operation; and the downhole radial stabilizer is configured to provide radial stabilization while allowing the string of downhole tools to translate axially.

17. The string of downhole tools of claim 12, wherein the casing cutting tool comprises at least one radially extendable cutting ann.

18. The string of downhole tools of claim 17, wherein the radially extendable cutting arm is configured to pivot radially outward about a hinge point.

19. The string of downhole tools of claim 12, wherein both the downhole radial stabilizer and the casing cutting tool are hydraulically actuated.

20. The string of downhole tools of claim 12, comprising first and second of the downhole radial stabilizers, the casing cutting tool being deployed axially between the first and second of the downhole radial stabilizers.

21. A method for forming a circumferential cut in a wellbore casing string, the method comprising:

(a) rotating a downhole tool string at a predetermined location in a cased wellbore, the tool string including at least one radial stabilizer and a wing-type casing cutter;

(b) causing at least one stabilizer block to extend radially outward from the radial stabilizer into contact with the cased wellbore, the extension of the stabilizer block operative to radially stabilize the tool string in the wellbore while allowing for axial translation of the tool string in the wellbore and for rotation of the at least one stabilizer block substantially freely with respect to a tool body of the at least one radial stabilizer;

(c) causing at least one cutting arm to extend radially outward from the wing-type casing cutter into contact with the cased wellbore, the extension Of the cutting arm operative to begin cutting the wellbore casing string; and (d) forming a circumferential cut in the wellbore casing string via continued rotation of the tool string and extension of the cutting arm thereby causing, the tool string to translate axially in the wellbore.

22. The method of claim 21, wherein the at least one stabilizer block and the at least one cutting arm are hydraulically actuated and extended substantially simultaneously in (b) and (c).

* * * * *